US011319861B1

(12) United States Patent
Hu et al.

(10) Patent No.: US 11,319,861 B1
(45) Date of Patent: May 3, 2022

(54) EXHAUST CONDUIT WITH A TEXTURED SURFACE

(71) Applicant: Ford Global Technologies, LLC, Dearborn, MI (US)

(72) Inventors: Leon Hu, Bloomfield Hills, MI (US); James Yi, West Bloomfiled, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/085,478

(22) Filed: Oct. 30, 2020

(51) Int. Cl.
*F01N 13/10* (2010.01)

(52) U.S. Cl.
CPC ..... *F01N 13/10* (2013.01)

(58) Field of Classification Search
CPC ..... F01N 13/10; F01N 3/02; F01N 13/1805; F01N 3/00; F01N 3/10; F28D 1/047; F28D 1/053; F02B 27/02
USPC ..... 60/320, 323, 313, 321; 293/113; 29/890.08; 180/89.2, 296, 309; 181/247–249, 264, 282, 239–241, 227, 181/228
See application file for complete search history.

(56) References Cited

U.S. PATENT DOCUMENTS 1,775,511 A * 9/1930 Chapman ..... F01N 13/10 181/240
3,459,444 A * 8/1969 Rofe ..... F16L 51/025 285/226
3,918,424 A 11/1975 Anderson et al.
5,031,401 A 7/1991 Hinderks
5,269,650 A 12/1993 Benson
6,487,854 B2 12/2002 Maus
6,990,806 B1 * 1/2006 Kinsel ..... F28F 1/18 60/321
7,377,261 B2 5/2008 Sukegawa et al.
7,794,671 B2 9/2010 Kariya et al.
8,474,251 B2 * 7/2013 Beyer ..... F02F 1/40 60/321
10,247,089 B1 4/2019 Wicks et al.
2002/0069643 A1 * 6/2002 Yoshizawa ..... F02D 41/1439 60/323
2005/0150222 A1 * 7/2005 Kalish ..... F01N 3/2857 60/302
2014/0109559 A1 * 4/2014 Leroy ..... F01N 13/10 60/323
2015/0167583 A1 6/2015 Sakamoto et al.
2016/0076425 A1 3/2016 Goffe
(Continued)

FOREIGN PATENT DOCUMENTS

CN 204082292 U 1/2015

*Primary Examiner* — Devon C Kramer
*Assistant Examiner* — Kelsey L Stanek
(74) *Attorney, Agent, or Firm* — Geoffrey Brumbaugh; McCoy Russell LLP

(57) ABSTRACT

An exhaust system is provided for an automotive engine of vehicles with exhaust conduits having a textured surface. The system comprises a plurality of cylinder exhaust ports, and an exhaust manifold including a plurality of exhaust runners fluidly coupled to the plurality of cylinder exhaust ports, where at least one exhaust runner of the plurality of exhaust runners includes a plurality of steps or dimples protruding outward from the exhaust runner. In one example, the system promotes an effective mixing of oxygen and hydrocarbons in the exhaust stream to reduce engine emissions.

16 Claims, 6 Drawing Sheets

(56) References Cited

U.S. PATENT DOCUMENTS

2019/0323460 A1* 10/2019 Flores Corona .....
F02M 35/10262

* cited by examiner

EXHAUST CONDUIT WITH A TEXTURED SURFACE

FIELD

The present disclosure relates generally to an exhaust conduit with a textured surface for use in an exhaust system of an automotive engine of a vehicle.

BACKGROUND/SUMMARY

It is challenging to reduce engine emissions, especially in cold start conditions when the catalyst conversion efficiency is low. Increased amounts of hydrocarbons (HCs) are emitted into the exhaust system through exhaust ports in cold start conditions. Hydrocarbons may be oxidized at high temperatures in the presence of oxygen ($O_2$). Nonetheless, proper mixing of the $O_2$ and HCs is needed to help increase HCs oxidation and reduce engine emissions. In previous exhaust systems, however, a desired level of exhaust gas mixing in the exhaust manifold has not been achieved.

One approach directed to increasing a probability of exhaust gas mixing is taught by Goffe in U.S. patent Ser. No. 14/486,217. Therein, a mixing chamber for diesel exhaust treatment is described that utilizes a textured surface. The mixing chamber is located near a diesel exhaust fluid doser. The texturing is in the form of a plurality of semi-spherical protrusions present on an internal surface of the mixing chamber that causes disruptions in the flow of the diesel exhaust near the inner radial surface of the mixing chamber. Another system is shown by Sakamoto et al. in U.S. patent Ser. No. 14/411,809. Therein, an exhaust passage structure for an internal combustion engine is described. Inner exhaust passages of the internal combustion engine are provided with three or more curves. An inner wall of one of the curves is configured with a step protruding inward along a direction of the exhaust gas flow, thereby enhancing heat radiation and turbulent diffusion of the exhaust gas.

However, the inventors herein have identified potential problems in the approaches such as those noted above. As one example, the texturing of the inner radial surface of a conduit described in Goffe and Sakamoto causes a decrease in an overall cross-sectional area of the exhaust passage. Moreover, a height of the steps or protrusions may increase pressure loss, thereby causing a separation of the exhaust gas flow. Additionally, the systems described in Goffe and Sakamoto are not directed to increasing HCs oxidation in an exhaust runner.

The inventors herein have recognized the above issues, and others, and have developed an exhaust system which comprises a plurality of cylinder exhaust ports, and an exhaust manifold including a plurality of exhaust runners fluidly coupled to the plurality of cylinder exhaust ports, where at least one exhaust runner of the plurality of exhaust runners includes a plurality of steps or dimples protruding outward from the exhaust runner.

The exhaust system, according to the present disclosure, includes exhaust runners with textured surfaces configured to promote mixing of $O_2$ and HCs in the exhaust stream to reduce engine emissions. As one example, the texturing may be in the form of a plurality of steps or dimples present on an inner radial surface of an exhaust runner extending outward, such that an outer radial surface of the exhaust runner appears to have multiple protrusions. As the exhaust gas flows through the runner, the plurality of steps or dimples creates turbulence near the surface of the exhaust runner and enhances the mixing of $O_2$ and HCs, thereby enhancing the hydrocarbons oxidation rate.

In another example, the shape of each textured surface structure is configured in a way such that a face of each step or dimple is perpendicular to the surface of the exhaust runner. This configuration can generate a strong turbulence and enhance an overall mixing effect especially in a reverse flow condition. In addition, this configuration helps reduce pressure loss when the exhaust gas flows downstream. Therefore, the system of the present disclosure not only increases HCs oxidation rate in the exhaust runners and manifold but also keeps the pressure loss minimized.

The surface texturing of exhaust runners, according to the present disclosure, does not decrease the overall cross-section of the exhaust passage. The plurality of steps or dimples in an inner radial surface of an exhaust runner allows exhaust gas mixing without increasing flow loss. Thus, the exhaust system of the present disclosure may be applied to any vehicle having an engine with exhaust runners and exhaust manifold.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1-5 are shown to scale, although other relative dimensions may be used if desired.

DETAILED DESCRIPTION

Figure 1:
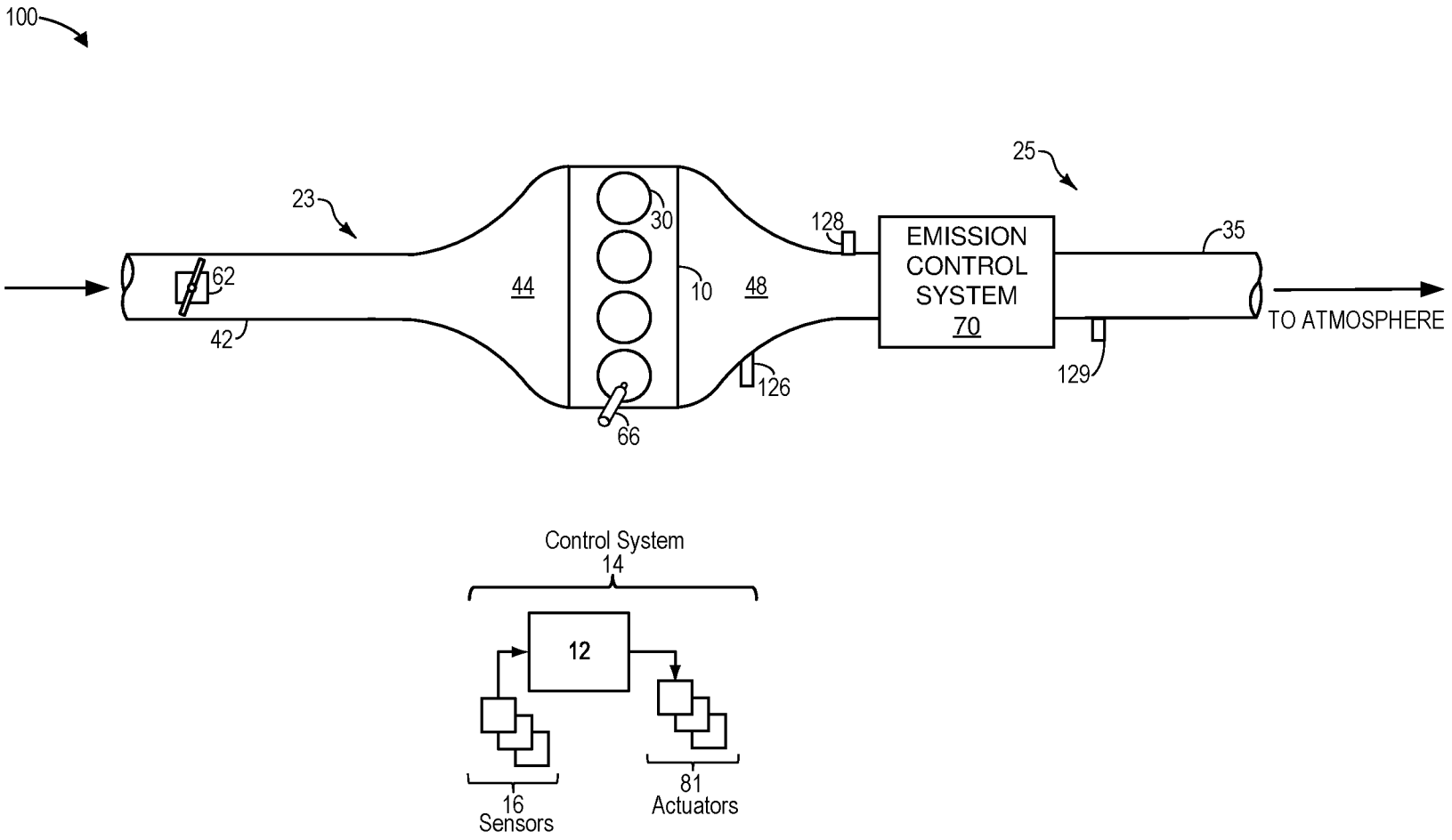
FIG. 1 shows an example embodiment of a vehicle exhaust system, according to the present disclosure.
Figure 2A:
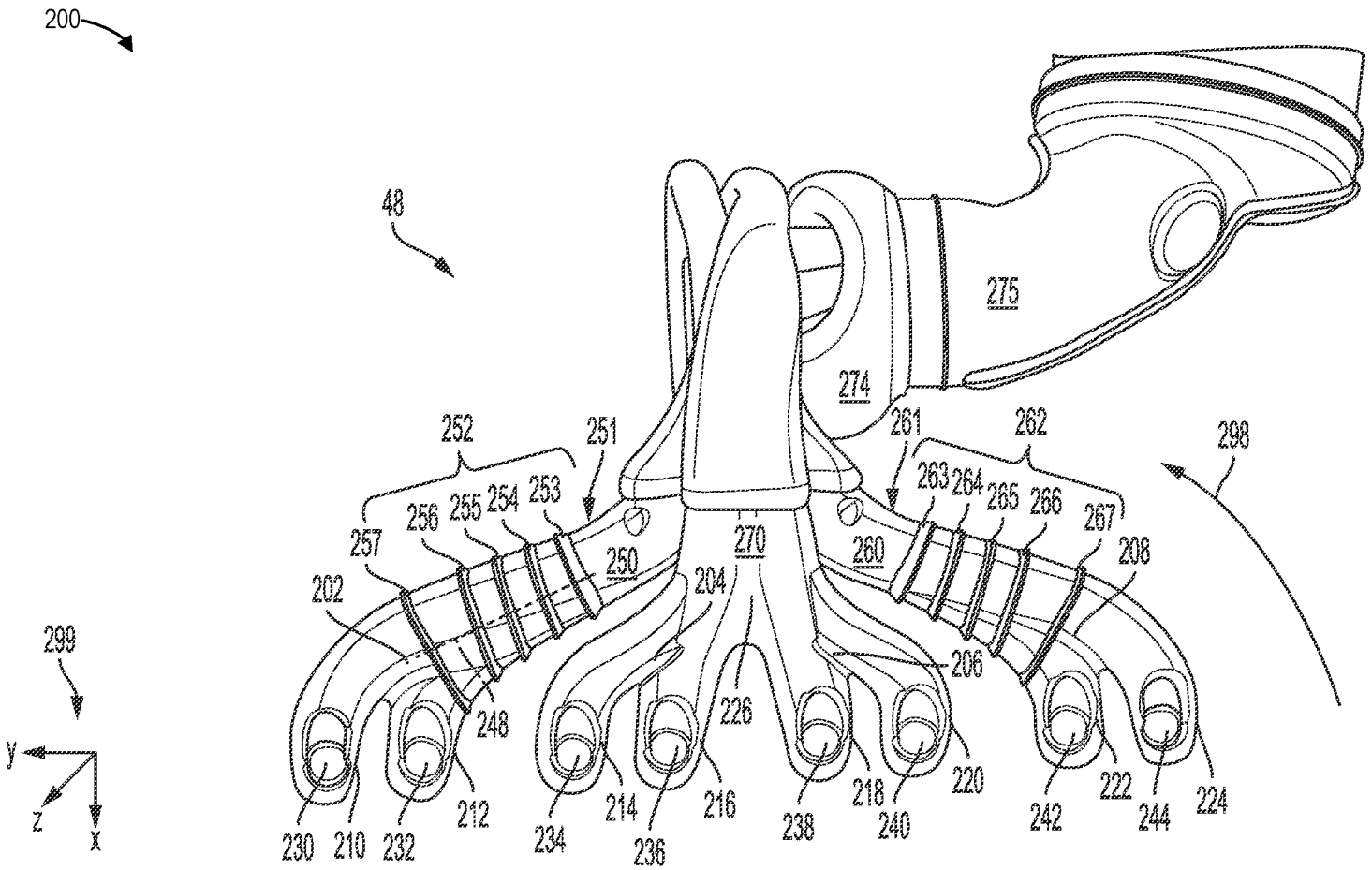
FIG. 2A shows a perspective view of an exhaust manifold with exhaust runners including a plurality of steps, in accordance with an example of the present disclosure.
Figure 2B:
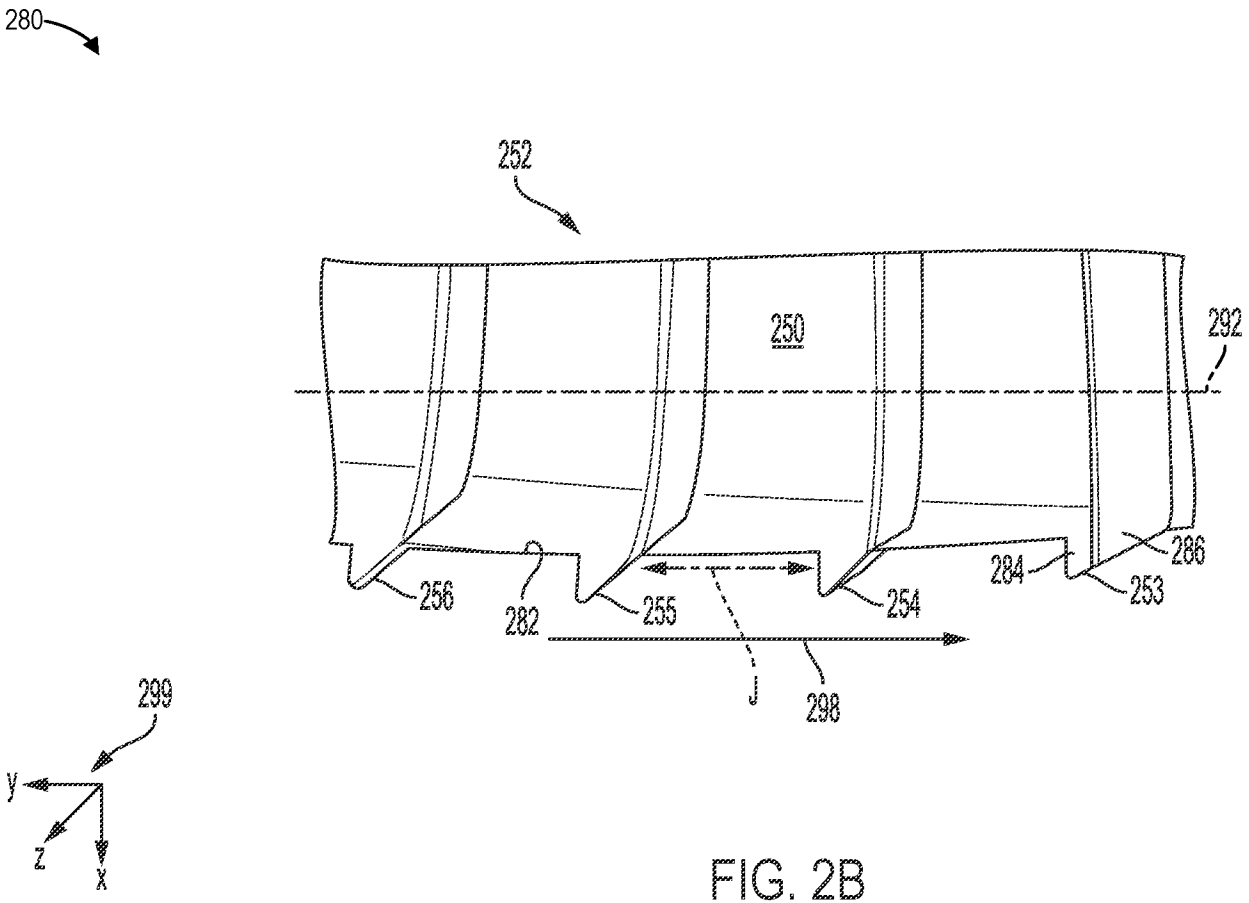
FIG. 2B shows a cross-sectional view of one of the exhaust runners of FIG. 2A.
Figure 3A:
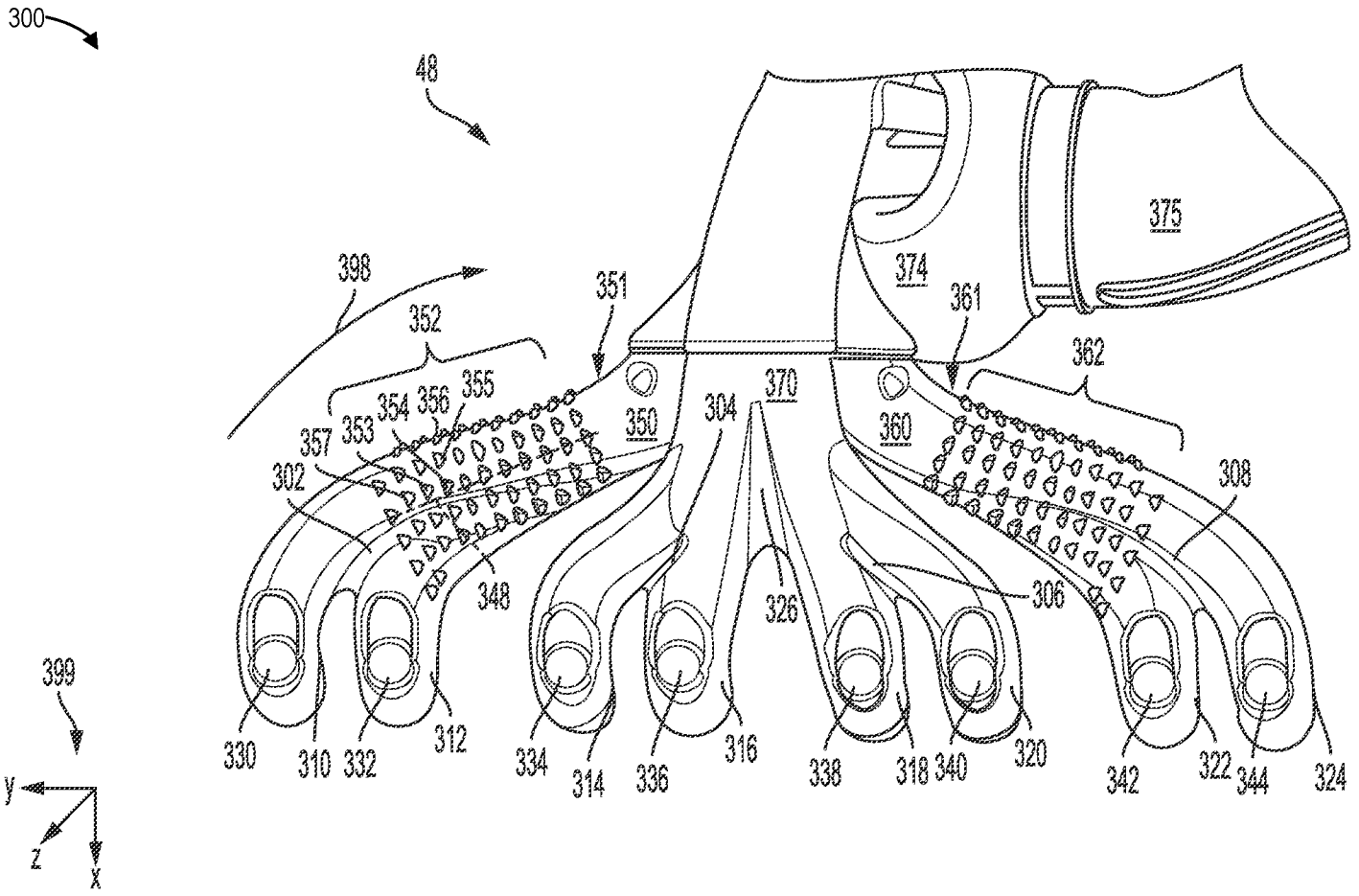
FIG. 3A shows a perspective view of an exhaust manifold with exhaust runners including a plurality of dimples, in accordance with an example of the present disclosure.
Figure 3B:
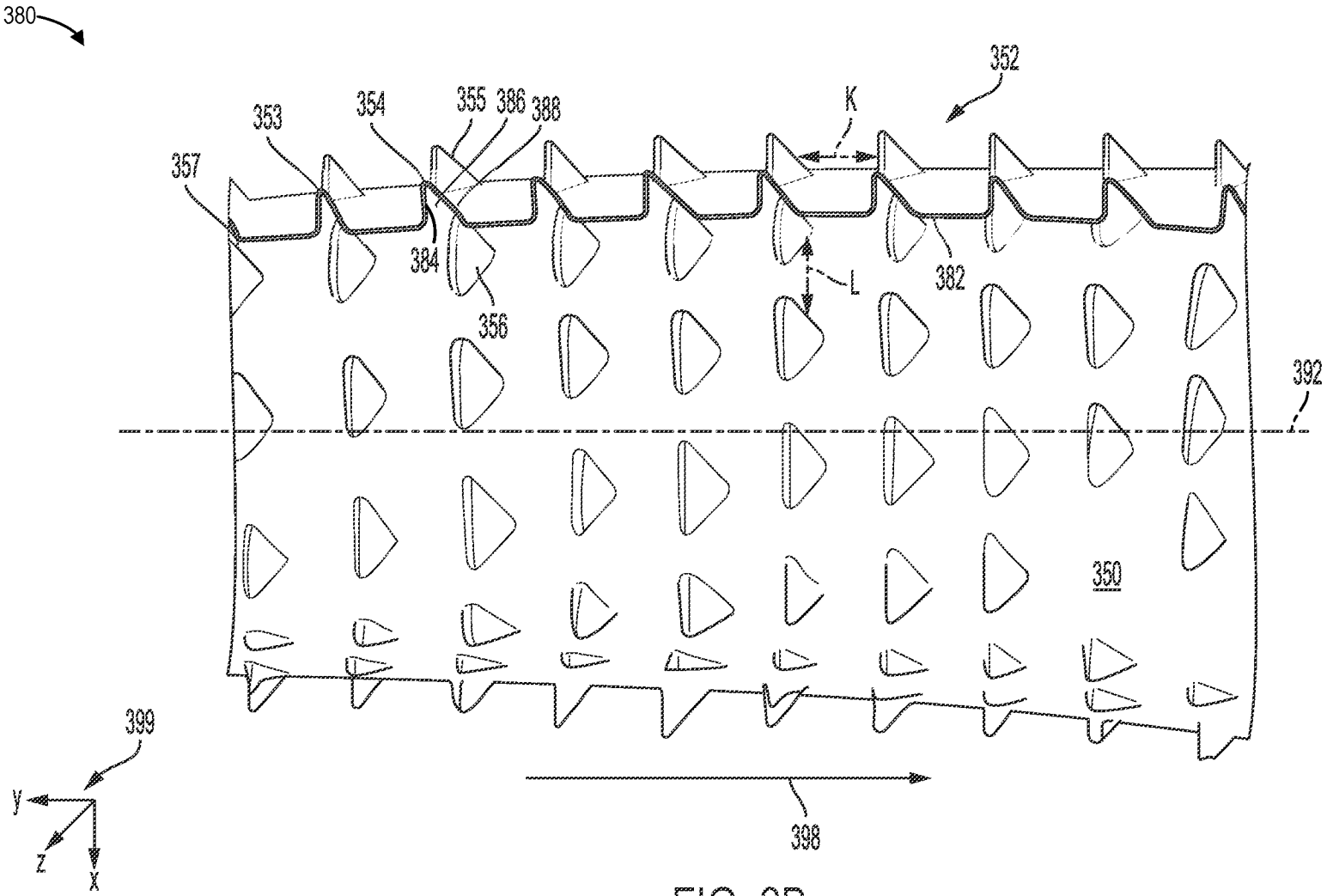
FIG. 3B shows a cross-sectional view of one of the exhaust runners of FIG. 3A.
Figure 4:
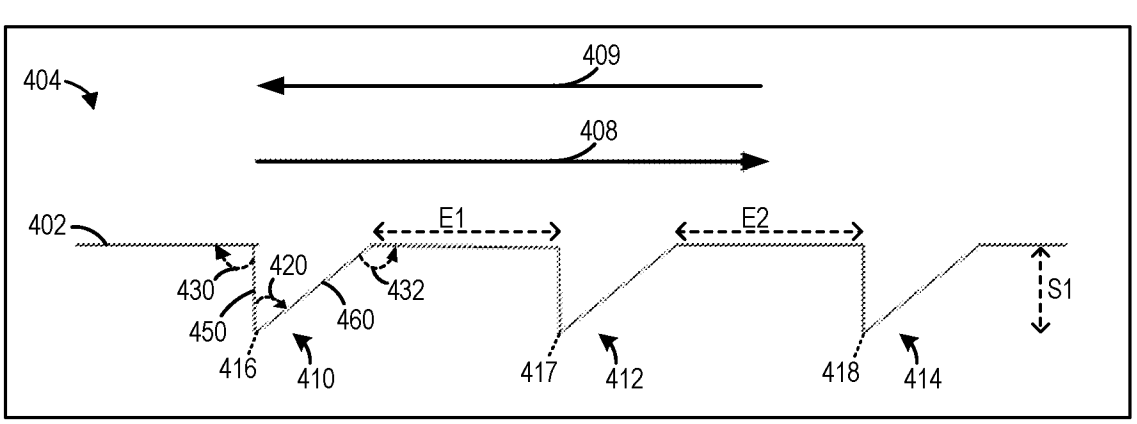
FIG. 4 shows an exhaust runner surface with a plurality of textured surface structures, according to the present disclosure.

The following description relates to a vehicle exhaust system that comprises an exhaust manifold with multiple exhaust runners, each exhaust runner having a textured surface configured to promote oxidation of hydrocarbons. Fluid dynamics and modeling are complicated, however, the inventors herein found unexpected results by creating various textured surface structures, such as steps or dimples on an inner radial surface of an exhaust runner. An exemplary vehicle exhaust system including an exhaust manifold configured for mixing HCs and $O_2$, according to the present disclosure, is shown in FIG. 1. FIG. 2A illustrates a perspective view of the exhaust manifold with exhaust runners having a surface texturing with a plurality of steps on an inner radial surface of each runner. The surface of each exhaust runner is textured in a way such that the plurality of steps appears to be radial grooves from an inside of the runner and radial protrusions emerging from an outer radial surface of the runner. FIG. 3A illustrates a perspective view of the exhaust manifold with exhaust runners having a surface texturing with a plurality of dimples on an inner radial surface of each runner. The plurality of dimples on the surface of an exhaust runner appears to be depressions from an inside of the runner and trihedral protrusions from an outer radial surface of the runner. FIGS. 2B and 3B show cross-sectional views of the exhaust runners with the plurality of textured surface structures of FIGS. 2A and 3A, respectively. FIG. 4 shows an exhaust runner surface with a plurality of steps or dimples in two dimensions, illustrating various angles and shapes. An alternative configuration of the textured surface structures with variations in shapes and angles is provided in FIG. 5.

FIG. 1 shows a schematic depiction of an exemplary vehicle system 100. The vehicle system 100 includes an engine 10 having a plurality of cylinders 30. The engine 10 includes an intake system 23 and an exhaust system 25. The intake system 23 includes a throttle 62 fluidly coupled to an engine intake manifold 44 via an intake passage 42. The exhaust system 25 includes an exhaust manifold 48 leading to an exhaust passage 35 that routes exhaust gas to the atmosphere. The exhaust system 25 may include an emissions control system 70 including one or more emission control devices, which may be mounted in a close-coupled position in the exhaust. One or more emission control devices may include a three-way catalyst, lean NOx trap, gasoline/diesel particulate filter, oxidation catalyst, etc. It can be appreciated that other components may be included in the engine such as a variety of valves and sensors.

Engine 10 may receive fuel from a fuel system (not shown) including a fuel tank and one or more pumps for pressurizing fuel delivered to the injectors 66 of engine 10. While only a single injector 66 is shown, additional injectors are provided for each cylinder. It can be appreciated that the fuel system may be a returnless fuel system, a return fuel system, or various other types of fuel system. The fuel tank may hold a plurality of fuel blends, including fuel with a range of alcohol concentrations, such as various gasoline-ethanol blends, including E10, E85, gasoline, etc., and combinations thereof.

The vehicle system 100 may further include control system 14. Control system 14 is shown receiving information from a plurality of sensors 16 (various examples of which are described herein) and sending control signals to a plurality of actuators 81 (various examples of which are described herein). As one example, sensors 16 may include temperature sensor 126 and upstream and downstream exhaust gas sensor 128, 129 (such as a binary HEGO sensor and/or UEGO sensor). Other sensors such as pressure, temperature, and composition sensors may be coupled to various locations in the vehicle system 100. The actuators may include fuel injector 66, throttle 62, and a flow control device (not pictured in FIG. 1). The control system 14 may include a controller 12. The controller 12 may receive input data from the various sensors, process the input data, and trigger the actuators in response to the processed input data based on instruction or code programmed therein corresponding to one or more routines.

The plurality of cylinders of the engine 10 may exhaust combustion gases into cylinder exhaust ports coupled thereto. The exhaust manifold 48 is directly coupled to and integrated within a cylinder head of the engine 10. Each cylinder of the engine 10 may be coupled to the exhaust manifold 48 via an exhaust runner (not pictured in FIG. 1). Each exhaust runner may be coupled to a respective cylinder exhaust port and flow of exhaust gas out of each exhaust port may be controlled by a respective exhaust valve. In some examples, one or more or each of the cylinders may include more than one exhaust valve, exhaust port, and exhaust runner. Moreover, each exhaust runner of the exhaust manifold 48 may include surface texturing in the form of steps or dimples, which promote proper mixing of hydrocarbons and oxygen in the exhaust gases. This enhances oxidation of unburned hydrocarbons and reduces emissions. More details about exhaust runners and their textured surface structures will be provided with respect to subsequent figures. Exhaust gases entering the plurality of exhaust runners may converge and mix at one or more junctions of the exhaust manifold 48 and may further be directed to other engine components, such as the emission control system 70.

FIG. 2A shows a perspective view 200 of the exhaust manifold 48 of FIG. 1, in accordance with a first example of the present disclosure. Components previously introduced are numbered similarly in subsequent figures. The cylinder head, engine block, and other components/systems are not shown. A coordinate axes 299 is provided for reference. The Z axis may be parallel to a gravitational axis. Further, the Y axis may be a lateral or horizontal axis and the X axis may be a longitudinal axis. The exhaust manifold 48 includes a plurality of exhaust runners, a plurality of exhaust junctions, and a plurality of steps on a surface of each exhaust runner. More details on each of these elements are presented below.

Exhaust runners 210 and 212 may be coupled with a first cylinder (not shown) via cylinder exhaust ports 230 and 232, respectively. Exhaust runners 214 and 216 may be coupled with a second cylinder (not shown) via cylinder exhaust ports 234 and 236, respectively. Exhaust runners 218 and 220 may be coupled with a third cylinder (not shown) via cylinder exhaust ports 238 and 240, respectively. Exhaust runners 222 and 224 may be coupled with a fourth cylinder (not shown) via cylinder exhaust ports 242 and 244, respectively. As depicted in FIG. 1, each cylinder exhaust port serves as an inlet to each corresponding exhaust runner. Further, each cylinder exhaust port may serve as an interface between a corresponding cylinder and runner.

Each pair of exhaust runners coupled with a cylinder (e.g., exhaust runners 210 and 212 coupled with a first cylinder, exhaust runners 214 and 216 coupled with a second cylinder, exhaust runners 218 and 220 coupled with a third cylinder, and exhaust runners 222 and 224 coupled with a fourth cylinder) has a distance of separation between each other. The exhaust runner pair 210 and 212 is spatially separated from the exhaust runner pair 214 and 216, the exhaust runner pair 214 and 216 is spatially separated from the exhaust runner pair 218 and 220, and the exhaust runner pair 218 and 220 is spatially separated from the exhaust runner pair 222 and 224. Similarly, the exhaust runners within each pair are also spatially separated from each other. For example, the exhaust runner 210 is spatially separated (e.g., spaced apart) from the exhaust runner 212, the exhaust runner 214 is spatially separated from the exhaust runner 216, the exhaust runner 218 is spatially separated from the exhaust runner 220, and the exhaust runner 222 is spatially separated from the exhaust runner 224.

A direction of flow of exhaust gases through the plurality of exhaust runners, downstream of the cylinder exhaust ports, is indicated by an arrow 298. As shown in FIG. 2A, the exhaust runner 210 and the exhaust runner 212 may be fluidly coupled to each other via an exhaust junction 202. Exhaust gases entering the exhaust junction 202 through the exhaust runners 210 and 212 may converge and mix with one another. Exhaust gases may subsequently travel from the exhaust junction 202 to a first merged runner 250. The exhaust runner 222 and the exhaust runner 224 may be fluidly coupled to each other via exhaust junction 208. Exhaust gases entering the exhaust junction 208 through the exhaust runners 222 and 224 may converge and mix with one another. Exhaust gases may subsequently travel from the exhaust junction 208 to a second merged runner 260. The exhaust runner 214 and the exhaust runner 216 may be fluidly coupled to each other via exhaust junction 204. Exhaust gases entering the exhaust junction 204 through the exhaust runners 214 and 216 may converge and mix with one another. The exhaust runner 218 and the exhaust runner 220 may be fluidly coupled to each other via exhaust junction 206. Exhaust gases entering the exhaust junction 206 through the exhaust runners 218 and 220 may converge and mix with one another. Additionally, the exhaust runner pair of exhaust runner 214 and exhaust runner 216, and the exhaust runner pair of exhaust runner 218 and exhaust runner 220 may be fluidly coupled to each other via exhaust junction 226. Thus, exhaust gases entering the exhaust junctions 204 and 206 may further converge and mix with one another at the exhaust junction 226. Exhaust gases may subsequently travel from the exhaust junction 226 to a third merged runner 270. Further, the first merged runner 250 forms a first outlet, the second merged runner 260 forms a second outlet, and the third merged runner 270 forms a third outlet of the exhaust manifold. Each outlet is coupled to a turbocharger turbine 274 and exhaust gas from each outlet mixes at the turbocharger and/or in a passage 275, from where the exhaust gases are distributed to other engine components (such as the emission control system 70).

Other embodiments may include exhaust runners of differing shape, size, and relative spacing compared to those parameters displayed by FIG. 2A. Similarly, other embodiments may include cylinder exhaust ports, junctions, exhaust passages, and other elements of the exhaust manifold that differ in shape, size, and relative spacing compared to those parameters displayed by FIG. 2A.

Each of the first merged runner 250, the second merged runner 260, and the third merged runner 270 may include surface texturing. In some examples, at least a portion of a surface of an exhaust runner includes a plurality of textured surface structures. The textured surface structures may be formed during casting of the runners. The textured surface of a runner may include a plurality of steps. Each step may extend radially around a circumference of an exhaust runner. In the illustrated example, the first merged runner 250 comprises an outer radial surface 251. A first portion 252 of the outer radial surface 251 of the first merged runner 250 is textured. The first portion 252 comprises five radial steps, a radial step 253, a radial step 254, a radial step 255, a radial step 256, and a radial step 257. The rest of the outer radial surface 251 (also referred to as a second portion of the outer radial surface 251) of the first merged runner 250 may not include steps. The second merged runner 260 comprises an outer radial surface 261. A first portion 262 of the outer radial surface 261 of the second merged runner 260 is also textured. The first portion 262 also comprises five radial steps, a radial step 263, a radial step 264, a radial step 265, a radial step 266, and a radial step 267. The rest of the outer radial surface 261 (also referred to as a second portion of the outer radial surface 261) of the second merged runner 260 may not include steps. The third merged runner 270, in the illustrated example, does not include any textured surface structures. However, in other examples, similar surface texturing with radial steps may be present on an outer radial surface of the third merged runner 270 as well.

Each radial step on the textured surfaces of the first merged runner 250 and the second merged runner 260 is continuous without any breaks or discontinuities. Further, each radial step of the plurality of radial steps is spaced apart from a neighboring radial step by an equal amount along a length of the runner. For example, the distance between the radial steps 254 and 255 may be similar to the distance between the radial steps 255 and 256 on the textured surface of the first merged runner 250. The radial steps are configured in a way such that they are present on an inner radial surface of each of the first merged runner 250 and the second merged runner 260 extending outwards in the form of "grooves" or "pockets", such that the outer radial surface of each runner appears to have multiple radial protrusions. Each radial step may have a shape of a triangle in at least one two-dimensional view. More details on the configuration of the steps will be presented in FIG. 2B.

In the illustrated example, surface texturing of the exhaust runners is applied in a way such that it begins downstream of a junction of two runners and extends up to a certain length of the merged runner. A non-textured surface of the merged runner follows the textured region. The non-textured surface does not include radial steps in an inner radial surface of the runner. For example, as shown in FIG. 2A, surface texturing (or radial steps) of the first portion 252 of the first merged runner 250 begins at the exhaust junction 202 (where the exhaust runners 210 and 212 meet), and extends up to 75% of a length of the first merged runner 250 from the exhaust junction 202 to the outlet. This length of surface texturing may vary in other embodiments. Similarly, the surface texturing (or radial steps) of the first portion 262 of the second merged runner 260 begins at the exhaust junction 208 (where the exhaust runners 222 and 224 meet), and extends up to 75% of a length of the second merged runner 260 from the exhaust junction 208 to the outlet. This length of surface texturing may vary in other embodiments. Having a textured surface located at this region of the merged runners provides an advantage. When exhaust gases entering the exhaust junctions through the runners converge, presence of a textured surface with a plurality of radial steps greatly enhances the mixing of hydrocarbons and oxygen, thereby increasing the oxidation rate of hydrocarbons.

In the illustrated example, the textured surface of an exhaust runner shows five radial steps; however, in other examples, the system may comprise any suitable number of radial steps. Each spacing between two consecutive radial steps of the plurality of radial steps may or may not be equal. In some examples, the radial steps may be more closely spaced together than the spacing shown in FIG. 2A. In other examples, however, the radial steps may be spaced farther apart from each other compared to the spacing shown in FIG. 2A. In the illustrated example, the textured surface is shown to be present at a specific location of the exhaust runners. In other embodiments, however, surface texturing may be present anywhere along the length of the exhaust runners or the entire length of the exhaust runners. Additionally, any or entire surface of the exhaust runners, merged runners, junctions, and/or other parts of the exhaust manifold that requires mixing of HCs and $O_2$ may comprise surface texturing in the form of a plurality of radial steps, according to the present disclosure. Furthermore, in some embodiments, the exhaust manifold may be configured such that all of the exhaust runners comprise surface texturing in the form of radial steps. In other embodiments, the exhaust manifold may be configured such that only some of the exhaust runners comprise surface texturing in the form of radial steps and the rest of the exhaust runners comprise a non-textured surface without any radial steps. In yet other examples, the exhaust manifold may be configured such that each exhaust runner may have a varying degree and length of surface texturing depending on the needs of the system.

FIG. 2B shows a cross-sectional view 280 of the first portion 252 of the first merged runner 250 of FIG. 2A taken along a dotted line 248. As such, components introduced previously are numbered similarly and not reintroduced. The first portion 252 of the first merged runner 250 may be shaped as a hollow cylinder with an axis 292 passing laterally through the center of the first portion 252 (central axis of the runner). The central axis 292 may be parallel to the y-axis of reference axes 299.

The cross-sectional view 280 shows an inner radial surface 282 of the first portion 252 of the first merged runner 250 and a channel enclosed by the inner radial surface that carries gases. The channel may be a single continuous passage. The inner radial surface 282 shows the radial steps 253, 254, 255 and 256 from an inside of the merged runner. Two consecutive radial steps may be separated by a distance J. The distance J between any two consecutive radial steps may remain the same or it may vary.

As appreciated by FIG. 2B, each radial step is a triangular-shaped radial groove configured on the inner radial surface 282 of the first portion 252 of the first merged runner 250. Each radial step has two faces that join to form the groove. For example, the radial step 253 has a first face 284 and a second face 286 that meet to form a triangular-shaped groove. The radial steps are configured in a way such that the first face of each radial step is perpendicular to the inner radial surface 282 and the second face of each radial step is obliquely oriented at an angle with respect to the inner radial surface 282 of the first merged runner 250. For example, as illustrated in FIG. 2B, the first face 284 of the radial step 253 is oriented perpendicularly to the inner radial surface 282. However, the second face 286 of the radial step 253 is oriented obliquely forming an angle with each of the first face 284 and the inner radial surface 282 of the first merged runner 250. More details about the types of angles formed will be presented in FIG. 4.

Turning to the flow of exhaust gases, some performance of the textured surface and its effect on the flow are related. The presence of radial grooves or steps on the inner radial surface 282 of the first merged runner 250 can positively impact gas flow. The plurality of radial grooves or steps provides key advantages. As depicted in FIG. 2B, the direction of flow of exhaust gases downstream through the first merged runner 250 is indicated by the arrow 298. As the exhaust gases flow from a first end to a second end of the first merged runner 250, the plurality of steps creates a strong turbulence near the inner radial surface 282 of the first merged runner 250. This turbulence in the gases enhances the mixing of the residual oxygen with hydrocarbons, leading to an enhancement of the HCs oxidation rate. This, in turn, reduces the engine HCs emissions.

Moving to FIG. 3A, FIG. 3A shows a perspective view 300 of the exhaust manifold 48 of FIG. 1, in accordance with a second example of the present disclosure. As such, components previously introduced are numbered similarly in subsequent figures. The cylinder head, engine block, and other components/systems are not shown. A coordinate axes 399 is provided for reference. The Z axis may be parallel to a gravitational axis. Further, the Y axis may be a lateral or horizontal axis and the X axis may be a longitudinal axis. The exhaust manifold 48 includes a plurality of exhaust runners, a plurality of exhaust junctions, and a plurality of dimples on a surface of each exhaust runner. More details on each of these elements are presented below.

Exhaust runners 310 and 312 may be coupled with a first cylinder (not shown) via cylinder exhaust ports 330 and 332, respectively. Exhaust runners 314 and 316 may be coupled with a second cylinder (not shown) via cylinder exhaust ports 334 and 336, respectively. Exhaust runners 318 and 320 may be coupled with a third cylinder (not shown) via cylinder exhaust ports 338 and 340, respectively. Exhaust runners 322 and 324 may be coupled with a fourth cylinder (not shown) via cylinder exhaust ports 342 and 344, respectively. As depicted in FIG. 1, each cylinder exhaust port, serves as an inlet to each corresponding exhaust runner. Further, each cylinder exhaust port may serve as an interface between a corresponding cylinder and runner.

Each pair of exhaust runners coupled with a cylinder (e.g., exhaust runners 310 and 312 coupled with a first cylinder, exhaust runners 314 and 316 coupled with a second cylinder, exhaust runners 318 and 320 coupled with a third cylinder, and exhaust runners 322 and 324 coupled with a fourth cylinder) has a distance of separation between each other. The exhaust runner pair 310 and 312 is spatially separated from the exhaust runner pair 314 and 316, the exhaust runner pair 314 and 316 is spatially separated from the exhaust runner pair 318 and 320, and the exhaust runner pair 318 and 320 is spatially separated from the exhaust runner pair 322 and 324. Similarly, the exhaust runners within each pair are also spatially separated from each other. For example, the exhaust runner 310 is spatially separated (e.g., spaced apart) from the exhaust runner 312, the exhaust runner 314 is spatially separated from the exhaust runner 316, the exhaust runner 318 is spatially separated from the exhaust runner 320, and the exhaust runner 322 is spatially separated from the exhaust runner 324.

A direction of flow of exhaust gases through the plurality of exhaust runners, downstream of the cylinder exhaust ports, is indicated by an arrow 398. As shown in FIG. 3A, the exhaust runner 310 and the exhaust runner 312 may be fluidly coupled to each other via an exhaust junction 302. Exhaust gases entering the exhaust junction 302 through the exhaust runners 310 and 312 may converge and mix with one another. Exhaust gases may subsequently travel from the exhaust junction 302 to a first merged runner 350. The exhaust runner 322 and the exhaust runner 324 may be fluidly coupled to each other via exhaust junction 308. Exhaust gases entering the exhaust junction 308 through the exhaust runners 322 and 324 may converge and mix with one another. Exhaust gases may subsequently travel from the exhaust junction 308 to a second merged runner 360. The exhaust runner 314 and the exhaust runner 316 may be fluidly coupled to each other via exhaust junction 304. Exhaust gases entering the exhaust junction 304 through the exhaust runners 314 and 316 may converge and mix with one another. The exhaust runner 318 and the exhaust runner 320 may be fluidly coupled to each other via exhaust junction 306. Exhaust gases entering the exhaust junction 306 through the exhaust runners 318 and 320 may converge and mix with one another. Additionally, the exhaust runner pair of exhaust runner 314 and exhaust runner 316, and the exhaust runner pair of exhaust runner 318 and exhaust runner 320 may be fluidly coupled to each other via exhaust junction 326. Thus, exhaust gases entering the exhaust junctions 304 and 306 may further converge and mix with one another at the exhaust junction 326. Exhaust gases may subsequently travel from the exhaust junction 326 to a third merged runner 370. Further, the first merged runner 350 forms a first outlet, the second merged runner 360 forms a second outlet, and the third merged runner 370 forms a third outlet of the exhaust manifold. Each outlet is coupled to a turbocharger turbine 374 and exhaust gas from each outlet mixes at the turbocharger and/or in a passage 375, from where the exhaust gases are distributed to other engine components (such as the emission control system 70).

Other embodiments may include exhaust runners of differing shape, size, and relative spacing compared to those parameters displayed by FIG. 3A. Similarly, other embodiments may include cylinder exhaust ports, junctions, exhaust passages, and other elements of the exhaust manifold that differ in shape, size, and relative spacing compared to those parameters displayed by FIG. 3A.

Each of the first merged runner 350, the second merged runner 360, and the third merged runner 370 may include surface texturing. In some examples, at least a portion of a surface of an exhaust runner includes a plurality of textured surface structures. The textured surface structures may be formed during casting of the runners. The textured surface of a runner may include a plurality of dimples. The plurality of dimples may be arranged in radial rows around a circumference of an exhaust runner. In the illustrated example, the first merged runner 350 comprises an outer radial surface 351. A first portion 352 of the outer radial surface 351 of the first merged runner 350 is textured. The first portion 352 comprises multiple radially-arranged dimples along a certain length of the first merged runner 350. The rest of the outer radial surface 351 (also referred to as a second portion of the outer radial surface 351) of the first merged runner 350 may not include dimples. The second merged runner 360 comprises an outer radial surface 361. A first portion 362 of the outer radial surface 361 of the second merged runner 360 is also textured. The first portion 362 also comprises multiple radially-arranged dimples along a certain length of the second merged runner 360. The rest of the outer radial surface 361 (also referred to as a second portion of the outer radial surface 361) of the second merged runner 360 may not include dimples. The third merged runner 370, in the illustrated example, does not include any textured surface structures. However, in other examples, similar surface texturing with a plurality of dimples may be present on a surface of the third merged runner 370 as well.

Each dimple of the plurality of dimples on a textured surface of each of the first merged runner 350 and the second merged runner 360 may be spaced apart from a neighboring dimple by an equal amount. For example, as shown in FIG. 3A, a dimple 354 and a dimple 355 may be separated by a distance that is similar to a distance between the dimple 355 and a dimple 356, within the same radial row. Additionally, a distance separating a dimple 357 from a dimple 353 may be similar to a distance separating the dimple 353 from the dimple 354, between consecutive radial rows. Further, the distance between two consecutive dimples within a radial row may be similar to the distance between two consecutive dimples between consecutive radial rows. For example, the distance between the dimples 354 and 355 may be similar to the distance between the dimples 354 and 353.

The dimples are configured in a way such that they are present on an inner radial surface of each of the first merged runner 350 and the second merged runner 360 extending outwards, such that the outer radial surface of each runner appears to have multiple protrusions. Each dimple may have a shape of a trihedral in at least one two-dimensional view. More details on the configuration of the dimples will be presented in FIG. 3B.

In the illustrated example, surface texturing of the exhaust runners is applied in a way such that it begins downstream of a junction of two runners and extends up to a certain length of the merged runner. A non-textured surface of the merged runner follows the textured region. The non-textured surface does not include dimples in an inner radial surface of the runner. For example, as shown in FIG. 3A, surface texturing (or dimples) of the first portion 352 of the first merged runner 350 begins at the exhaust junction 302 (where the exhaust runners 310 and 312 meet), and extends up to 75% of a length of the first merged runner 350 from the exhaust junction 302 to the outlet. This length of surface texturing may vary in other embodiments. Similarly, the surface texturing (or dimples) of the first portion 362 of the second merged runner 360 begins at the exhaust junction 308 (where the exhaust runners 322 and 324 meet), and extends up to 75% of a length of the second merged runner 360 from the exhaust junction 308 to the outlet. This length of surface texturing may vary in other embodiments. Having a textured surface located at this region of the merged runners provides an advantage. When exhaust gases entering the exhaust junctions through the runners converge, presence of a textured surface with a plurality of dimples greatly enhances the mixing of hydrocarbons and oxygen, thereby increasing the oxidation rate of hydrocarbons.

In the illustrated example, the textured surface of an exhaust runner shows a plurality of dimples; however, in other examples, the system may comprise a specific number of dimples. Each spacing between two consecutive dimples of the plurality of dimples may or may not be equal. In some examples, the dimples may be more closely spaced together than the spacing shown in FIG. 3A. In other examples, however, the dimples may be spaced farther apart from each other compared to the spacing shown in FIG. 3A. In the illustrated example, the textured surface is shown to be present at a specific location of the exhaust runners. In other embodiments, however, surface texturing with the plurality of dimples may be present anywhere along the length of the exhaust runners or the entire length of the exhaust runners. Additionally, any or entire surface of the exhaust runners, merged runners, junctions, and/or other parts of the exhaust manifold that requires mixing of HCs and $O_2$ may comprise surface texturing in the form of a plurality of dimples, according to the present disclosure. It is also possible that an exhaust runner may comprise the plurality of dimples in a slightly different arrangement. For example, instead of forming radial rows, the plurality of dimples may be arranged discretely around the surface of the exhaust runner. Further, it is possible that certain parts of the exhaust manifold may comprise partial surface texturing. For example, instead of forming full radial rows, the plurality of dimples may be arranged in semi-radial rows covering only a partial surface of the exhaust runner along the length. Furthermore, in some embodiments, the exhaust manifold may be configured such that all of the exhaust runners comprise surface texturing in the form of dimples. In other embodiments, the exhaust manifold may be configured such that only some of the exhaust runners comprise surface texturing in the form of dimples and the rest of the exhaust runners comprise a non-textured surface without any dimples. In yet other examples, the exhaust manifold may be configured such that each exhaust runner may have a varying degree and length of surface texturing depending on the needs of the system.

FIG. 3B shows a cross-sectional view 380 of the first portion 352 of the first merged runner 350 of FIG. 3A taken along a dotted line 348. As such, components introduced previously are numbered similarly and not reintroduced. The first portion 352 of the first merged runner 350 may be shaped as a hollow cylinder with an axis 392 passing laterally through the center of the first portion 352 (central axis of the runner). The central axis 392 may be parallel to the y-axis of reference axes 399.

The cross-sectional view 380 shows an inner radial surface 382 of the first portion 352 of the first merged runner 350 and a channel enclosed by the inner radial surface that carries gases. The channel may be a single continuous passage. The inner radial surface 382 shows the plurality of dimples from an inside of the merged runner. The example dimples 353, 354, 355, 356 and 357 are also depicted in FIG. 3B. Any two consecutive dimples within the same radial row may be separated by a distance L. The distance L between any two consecutive dimples may remain the same or it may vary. The distance between two dimples, one from each radial row positioned consecutively, is referred to as K. The distance K between any two consecutive dimples, from consecutive radial rows, may remain the same or it may vary.

As appreciated by FIG. 3B, each dimple is a trihedral-shaped structure configured on the inner radial surface 382 of the first portion 352 of the first merged runner 350. Each dimple of the plurality of dimples has three faces that join to form the structure. For example, the dimple 354 has a first face 384, a second face 386, and a third face 388 that meet to form a trihedral-shaped structure. The dimples are configured in a way such that the first face of each dimple is perpendicular to the inner radial surface 382, and the second and third faces of each dimple are obliquely oriented at an angle with respect to the inner radial surface 382 of the first merged runner 350. For example, as illustrated in FIG. 3B, the first face 384 of the dimple 354 is oriented perpendicularly to the inner radial surface 382. However, the second face 386 and the third face 388 of the dimple 354 are oriented obliquely forming an angle with each of the first face 384 and the inner radial surface 382 of the first merged runner 350. More details about the types of angles formed will be presented in FIG. 4.

Turning to the flow of exhaust gases, some performance of the surface and its effect on the flow are related. The presence of dimples on the inner radial surface 382 of the first merged runner 350 can positively impact gas flow. The plurality of dimples provides key advantages. As depicted in FIG. 3B, the direction of flow of exhaust gases downstream through the first merged runner 350 is indicated by the arrow 398. As the exhaust gases flow from a first end to a second end of the first merged runner 350, the plurality of dimples creates a strong turbulence near the inner radial surface 382 of the first merged runner 350. This turbulence in the gases enhances the mixing of the residual oxygen with hydrocarbons, leading to an enhancement of the HCs oxidation rate. This, in turn, reduces the engine HCs emissions.

Turning to FIG. 4, FIG. 4 shows a generic side view 400 of an exhaust runner surface 402 in two dimensions with a plurality of textured surface structures configured therein. An example structure 410, an example structure 412, and an example structure 414 depicted in FIG. 4 may represent either the triangular-shaped radial steps or the trihedral-shaped dimples, in accordance with the embodiments of the present disclosure.

The direction of flow of exhaust gases may be represented by an arrow 408 on an inside 404 of the exhaust runner. The structures 410 and 412 may be separated by a distance E1. Similarly, the structures 412 and 414 may be separated by a distance E2. As discussed previously, the distance between any two consecutive structures throughout the textured surface may remain the same or it may vary. In the illustrated example, the distance E1 and the distance E2 are shown to be similar. In other examples, however, the distance E1 and the distance E2 may not be similar. The textured surface structures on the exhaust runner surface 402 may have a certain depth defining how deep the structures are configured. For example, the structures 410, 412, and 414 each may have a depth 51. The depth 51 may be similar for all the structures configured on the surface of the exhaust runner.

As discussed previously, the various faces of each of the dimple or the radial step join to form the respective structure. As depicted in FIG. 4, the example structure 410 comprises a first face 450 and a second face 460. The first face 450 and the second face 460 are oriented such that the respective faces join at a joining point 416 to form the structure 410. Similarly, respective faces of the structure 412 join at a joining point 417 to form the structure 412. Also, respective faces of the structure 414 join at a joining point 418 to form the structure 414. It is to be noted that in case of radial steps, according to the present disclosure, there are only two faces that join to form the structure. However, in case of dimples, there are three faces that join to form the structure, according to the present disclosure. Although, a third face of the structure is not shown in FIG. 4, it will be appreciated that all three faces of the dimple may join at various angles to form the structure.

As discussed previously with reference to FIGS. 2B and 3B, the first face of both the radial step and the dimple is configured to be perpendicular to the surface of the exhaust runner. The other faces of both the dimple and the radial step are oriented at an angle with respect to the first face as well as with respect to the surface of the exhaust runner. As shown in FIG. 4, the first face 450 of the structure 410 is oriented perpendicularly to the exhaust runner surface 402. An angle between the first face 450 of the structure 410 and the exhaust runner surface 402 is represented by a right angle 430. The second face 460 of the structure 410 is oriented obliquely, such that the second face 460 makes an acute angle 420 with the first face 450 and an obtuse angle 432 with the exhaust runner surface 402. In the illustrated example, the acute angle 420 is shown to be approximately 45 degrees. In other examples, however, the acute angle 420 may vary ranging from 30 degrees to 60 degrees. In the illustrated example, the obtuse angle 432 is shown to be approximately 135 degrees. In other examples, however, the obtuse angle 432 may vary ranging from 120 degrees to 150 degrees.

As described previously in the present disclosure, one of the advantages of having a plurality of textured surface structures (dimples or steps) on the surface of an exhaust runner is to create turbulence to enhance the mixing of $O_2$ and HCs, thereby reducing engine emissions. A configuration of dimples or steps with the first face being perpendicular to the exhaust runner surface has even more advantages. This particular configuration of textured surface structures can help reduce flow loss when the exhaust gases are flowing downstream along the arrow 408. In an internal combustion engine, reverse flow of exhaust gases may occur when an exhaust valve remains open while the piston is moving down, thereby pulling the exhaust flow into the cylinder and increasing the main flow loss. The reverse flow of exhaust gases may be represented by an arrow 409 in FIG. 4. During reverse flow of exhaust gases, the configuration of dimples or steps with the first face being perpendicular to the exhaust runner surface, will generate stronger turbulence and increase the mixing effect compared to a configuration of a dimple or step with non-perpendicular face. As a result, the overall mixing effect can be enhanced while the pressure loss of the main flow can be minimized especially during reverse flow. An additional advantage of the textured surface structures (steps and dimples) described in the present disclosure is that they do not reduce the overall effective cross-section of the exhaust passage, as the structures protrude in an outward direction. This is compared to a cross-sectional area of a smooth conduit having the same diameter as the exhaust passage, without the surface texturing.

In the present disclosure, two core example configurations of the textured surface structures (dimples and radial steps) on a surface of an exhaust runner have been disclosed. Exhaust runners or parts of exhaust manifold may be configured with other shapes/configurations of the structures that may show similar mixing effect of $O_2$ and HCs in the exhaust gases, without departing from the scope of this disclosure. One of the alternative configurations of the textured surface structures is presented in FIG. 5.

Figure 5:
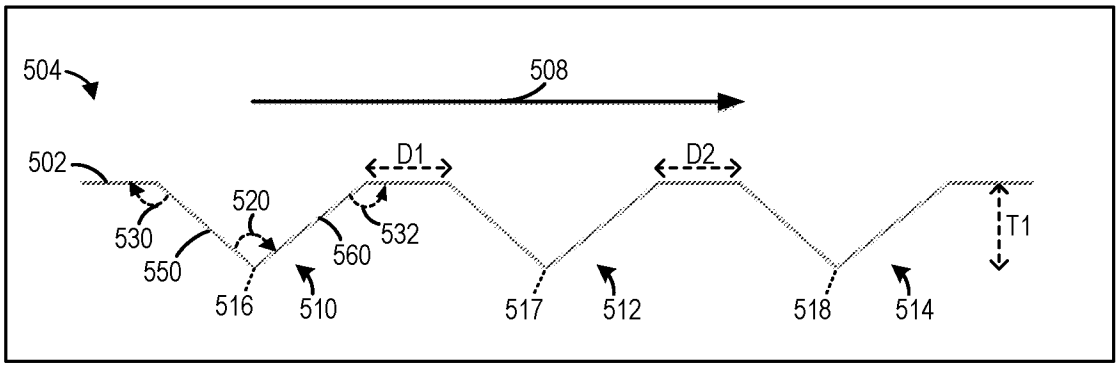
FIG. 5 shows an exhaust runner surface with a plurality of an alternative configuration of the textured surface structures, according to the present disclosure.

Referring to FIG. 5, FIG. 5 shows a generic side view 500 of an exhaust runner surface 502 in two dimensions with a plurality of an alternative configuration of the textured surface structures configured therein. An example structure 510, an example structure 512, and an example structure 514 depicted in FIG. 5 may represent either the radial steps or the dimples, in accordance with the embodiments of the present disclosure.

The direction of flow of exhaust gases may be represented by an arrow 508 on an inside 504 of the exhaust runner. The structures 510 and 512 may be separated by a distance D1. Similarly, the structures 512 and 514 may be separated by a distance D2. As discussed previously, the distance between any two consecutive structures throughout the textured surface may remain the same or it may vary. In the illustrated example, the distance D1 and the distance D2 are shown to be similar. In other examples, however, the distance D1 and the distance D2 may not be similar. Also, the distances D1 and D2 in FIG. 5 may be shorter than the distances E1 and E2 shown in FIG. 4. The textured surface structures on the exhaust runner surface 502 may have a certain depth defining how deep the structures are configured. For example, the structures 510, 512, and 514 each may have a depth T1. The depth T1 may be similar for all the structures configured on the surface of the exhaust runner.

As discussed previously, the various faces of each of the dimple or the radial step join to form the respective structure. As depicted in FIG. 5, the example structure 510 comprises a first face 550 and a second face 560. The first face 550 and the second face 560 are oriented such that the respective faces join at a joining point 516 to form the structure 510. Similarly, respective faces of the structure 512 join at a joining point 517 to form the structure 512. Also, respective faces of the structure 514 join at a joining point 518 to form the structure 514. It is to be noted that in case of radial steps, according to the present disclosure, there are only two faces that join to form the structure. However, in case of dimples, there are three faces that join to form the structure, according to the present disclosure. Although, a third face of the structure is not shown in FIG. 5, it will be appreciated that all three faces of the dimple may join at various angles to form the structure.

Unlike the configuration of dimples and radial steps described previously with reference to FIGS. 2B and 3B, none of the faces of the alternative configuration of the textured surface structures (shown in FIG. 5) are perpendicular to the surface of the exhaust runner. In this case, each face of the dimple or step is oriented obliquely at an angle with respect to the surface of the exhaust runner. For example, as shown in FIG. 5, both the first face 550 and the second face 560 of the structure 510 are oriented at an obtuse angle with respect to the exhaust runner surface 502. The first face 550 and the exhaust runner surface 502 make an angle 530. The second face 560 and the exhaust runner surface 502 make an angle 532. In the illustrated example, the angles 530 and 532 are both shown to be approximately 140 degrees. In other examples, however, the angles 530 and 532 may vary, each ranging from 120 degrees to 155 degrees. It is also possible that each of the first face 550 and the second face 560 may be oriented at similar angles or two different angles with respect to the exhaust runner surface 502. The first face 550 and the second face 560 of the structure 510 are also oriented such that they form an angle 520 with respect to each other. In the illustrated example, the angle 520 is shown to be approximately 100 degrees. In other examples, however, the angle 520 may vary ranging from 60 degrees to 130 degrees. This alternative configuration of the textured surface structures provides similar advantages for reducing engine emissions as described previously.

FIGS. 1-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. Further, reference axes 299 and 399 are included in FIGS. 2A-B and FIGS. 3A-B, respectively, in order to compare the views and relative orientations described below. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in at least one example. FIGS. 1-5 are drawn approximately to scale, although other dimensions or relative dimensions may be used.

It will be appreciated that the configurations and routines disclosed herein are exemplary in nature, and that these specific embodiments are not to be considered in a limiting sense, because numerous variations are possible. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An exhaust manifold system, comprising:

a plurality of exhaust runners configured to couple to respective exhaust ports of an engine, at least one exhaust runner of the plurality of exhaust runners including a textured surface, the textured surface including a plurality of steps protruding outward from the at least one exhaust runner, wherein the at least one exhaust runner has an inner radial surface and the plurality of steps comprise outward protrusions of the inner radial surface.

2. The system of claim 1, wherein the engine includes a cylinder head and the plurality of exhaust runners are integrated with the cylinder head.

3. The system of claim 1, wherein a first portion of an outer radial surface of the at least one exhaust runner includes the plurality of steps and a second portion of the outer radial surface of the at least one exhaust runner is devoid of the plurality of steps.

4. The system of claim 1, wherein the plurality of steps extend radially around a circumference of the at least one exhaust runner.

5. The system of claim 4, wherein each step is continuous without any breaks or discontinuities.

6. The system of claim 4, wherein each step has a triangular shape.

7. The system of claim 6, wherein a first face of each step is perpendicular to the inner radial surface of the at least one exhaust runner and a second face of each step is non-perpendicular to the inner radial surface of the at least one exhaust runner.

8. The system of claim 6, wherein no faces of the plurality of steps are perpendicular to the inner radial surface of the at least one exhaust runner.

9. The system of claim 4, wherein each step of the plurality of steps is spaced apart from a neighboring step by an equal amount.

10. The system of claim 1, wherein the at least one exhaust runner is a merged runner formed by coupling of two individual runners on an upstream end and the plurality of steps are positioned on the merged runner downstream of a junction of the two individual runners.

11. A system for an on-highway vehicle, comprising:

an engine having a plurality of cylinders;

an exhaust system coupled with the plurality of cylinders, the exhaust system including:

a plurality of cylinder exhaust ports; and an exhaust manifold comprising a plurality of exhaust runners coupled to the plurality of cylinder exhaust ports;

where at least one exhaust runner of the plurality of exhaust runners includes a plurality of triangular-shaped steps protruding outward from the exhaust runner, wherein each step extends radially around a circumference of the exhaust runner without any breaks or discontinuities.

12. The system of claim 11, wherein the plurality of triangular-shaped steps are included in an inner radial surface of the at least one exhaust runner, and wherein each step has a depth and a plurality of faces, each face oriented at an angle with respect to the inner radial surface of the at least one exhaust runner.

13. An exhaust manifold system, comprising:

a plurality of exhaust runners configured to couple to respective exhaust ports of an engine, at least one exhaust runner of the plurality of exhaust runners including a textured surface, the textured surface including a plurality of steps protruding outward from the at least one exhaust runner, wherein the at least one exhaust runner is a merged runner formed by coupling of two individual runners on an upstream end and the plurality of steps are positioned on the merged runner downstream of a junction of the two individual runners.

14. The system of claim 13, wherein the engine includes a cylinder head and the plurality of exhaust runners are integrated with the cylinder head.

15. The system of claim 13, wherein a first portion of an outer radial surface of the at least one exhaust runner includes the plurality of steps and a second portion of the outer radial surface of the at least one exhaust runner is devoid of the plurality of steps.

16. The system of claim 13, wherein the plurality of steps extend radially around a circumference of the at least one exhaust runner.

* * * * *